United States Patent [19]

Pase

[11] 4,004,475

[45] Jan. 25, 1977

[54] PORTABLE WRENCH FOR ROTARY MEMBERS

[75] Inventor: Hugh H. Pase, Cheshire, Conn.

[73] Assignee: Mimco Incorporated, Cheshire, Conn.

[22] Filed: Aug. 8, 1975

[21] Appl. No.: 603,161

Related U.S. Application Data

[63] Continuation of Ser. No. 447,007, Feb. 28, 1974, abandoned.

[52] U.S. Cl. ..... 81/57.14; 81/57.3

[51] Int. Cl.[2] ..... B25B 17/00

[58] Field of Search ..... 81/57.11, 57.12, 57.13, 81/57.14, 57.3, 125

[56] References Cited

UNITED STATES PATENTS

| | | | |
|---|---|---|---|
| 1,864,844 | 6/1932 | Meunier | 81/57.14 |
| 1,927,383 | 9/1933 | Bardwell | 81/57.13 |
| 2,578,279 | 12/1951 | Bardwell | 81/57.13 |
| 2,938,416 | 5/1960 | Maness | 81/57.13 |
| 3,162,072 | 12/1964 | Stewart | 81/125 |
| 3,616,713 | 11/1971 | Crouch | 81/57.4 |

*Primary Examiner*—James L. Jones, Jr.
*Attorney, Agent, or Firm*—St. Onge Mayers Steward & Reens

[57] ABSTRACT

A wrench for applying torque to a member that rotates, such as the rotary operating member by which to open the discharge gate for a railroad hopper car, the wrench being provided with a hollow hub or sleeve that fits over the rotary member and having means for locking it to the periphery of such member. A reduction-gear train multiplies the input force, the force exerted by the wrench on the member to be rotated, as well as the forces of reaction, being directly in line with the input force so that there is no tendency for the wrench to twist. Specific means are disclosed for locking the hub of the wrench to the rotary member and comprise a hook-shaped dog that is pivoted on the hub so that the hooked end of the dog extends through a lateral opening in the hub into engagement with a hole or recess in the periphery of the member. A release lever is provided for facilitating withdrawal of the dog to a retracted position and for holding it in that position while the wrench is being applied or removed.

12 Claims, 5 Drawing Figures

PORTABLE WRENCH FOR ROTARY MEMBERS

This is a continuation of application Ser. No. 447,007, filed Feb. 28, 1974, now abandoned.

BACKGROUND OF THE INVENTION

The present invention relates to force-multiplying tools for rotary members, and it relates more particularly to power wrenches for rotating the gate-operating shaft on a railroad hopper car.

Railroad hopper cars have a bottom discharge opening that is closed by means of a sliding gate. The operating mechanism for opening and closing the gate includes a rotary shaft having a free end by which it is rotated. The end of the shaft is provided with an enlarged head or capstan, which has holes extending generally radially through it to receive a pry-bar, and a square portion at the very end to which a hand wrench can be applied or the socket of a power tool connected. Usually the gate is opened by hand using a pry-bar, one end of which is placed in one of the holes in the capstan. A large pipe or monkey wrench can also be applied to the square portion of the capstan in order to complete the opening of the gate once it has been started, or to assist in getting it started. Frequently, it is impossible to open a gate by hand, even when a sledge hammer or other impact tool is used to try to jolt it free. Due to the extreme difficulty encountered in opening gates on many cars, workmen assigned to the job are frequently seriously injured. Furthermore, the connection on the end of the capstan becomes so badly worn that hand and power wrenches can not hold on it and are therefore useless.

Various power tools have been devised heretofore for opening hopper-car gates, but none have been entirely satisfactory because, among other things, they are too heavy and awkward to handle or cost too much to be practical. Furthermore, the capstan extends only a short distance outward of the track and beneath the outer side of the car, making it difficult to get at and to apply the necessary power directly in line with the capstan instead of some distance axially outward of it. Consequently, in all prior power wrenches or force-multiplying tools of which I am aware, the point at which power is applied is located some distance along the axis of rotation from the point at which connection is actually made with the capstan. Such an arrangement makes the tool twist when torque is exerted by it on a capstan, thereby making it extremely difficult to handle and reducing its efficiency considerably.

A primary object of the present invention is to eliminate such misalignment between the point at which power is applied to the force-multiplying device and the point at which the multiplied force is exerted on the capstan. Another object is to provide a force-multiplying device for opening hopper-car gates in which the connection with the operating shaft is made with the periphery of the capstan itself instead of with the wrench engagement surfaces provided, so that positive connection can be made even if the tool-engaging surfaces are badly worn. An important object of the invention is to provide a relatively lightweight portable power wrench for opening hopper-car gates in which the torque required to open the gate is executed within a plane perpendicular to the capstan of the operating shaft of the gate, instead of at some other point axially outward thereof.

SUMMARY OF THE INVENTION

The wrench of the present invention is a portable high-torque tool intended primarily for opening railroad car hopper gates and is provided with a cylindrically hollow hub rotatably supported within a central opening in the frame of the wrench and driven by suitable drive means such as a reduction gear and/or chain and sprocket. The inside diameter of the hollow hub is large enough to fit freely around the cylindrical capstan so that it rotates in the same plane of rotation as the capstan. The capstan is driven by a locking dog mounted on the hub, a portion of the locking dog being slidably movable into and out of a hole or recess in the periphery of the capstan for rapid engagement and disengagement.

In order to maintain complete alignment and balancing of the forces exerted by the drive mechanism internally of the wrench, the hub and drive gears should be mounted between the front and rear walls of the wrench housing or frame with their axes of rotation parallel to each other. Alignment of the external forces acting on the wrench is maintained by locating the locking dog substantially within the plane of rotation defined by the walls of the housing and by mounting the anti-rotation bar or similar means within the same plane. Consequently, the hub, drive-train, anti-rotation means and locking dog are fully aligned. Such alignment prevents twisting or distortion of any part of the wrench due to its being off-set along the axis of rotation, thereby making it possible to produce in a portable tool the great force required to open railroad hopper gates.

Some means must also be provided to fix the wrench against rotation when power is applied to it, so that the force is exerted on the member to be rotated. Such anti-rotation means may be a heavy bar that is attached to the wrench housing and extends laterally thereof far enough to engage a fixed object, such as the ground. Again the bar should be disposed within the plane of the housing, so that the reaction force on the wrench and the force exerted by the wrench on the capstan are directly in line with each other along the axis of rotation.

An important aspect of the present invention deals with the difficulty encountered with a hopper-gate operating mechanism, in which the square tool-attaching portion of the capstan intended for use with power tools or hand wrenches becomes so badly worn that the tool can not grip it.

In order to overcome this difficulty and at the same time avoid the problem of twisting the drive mechanism, a portion of the locking dog is slidably movable into driving engagement with the periphery of the capstan. Thus, no attempt is made to use the usual tool-attaching portion of a gate-operating capstan. Furthermore, by locking the wrench to the periphery of the capstan by means of the locking dog, rapid engagement and disengagement of the wrench is achieved.

DESCRIPTION OF PREFERRED EMBODIMENT

A particularly desirable embodiment will now be described in detail in connection with the accompanying drawings, wherein FIG. 1 is a perspective view of portions of the underside of a railroad hopper car with the power-wrench of the present invention in position on the operating-shaft for the gate in the discharge opening of the hopper;

Figure 1:
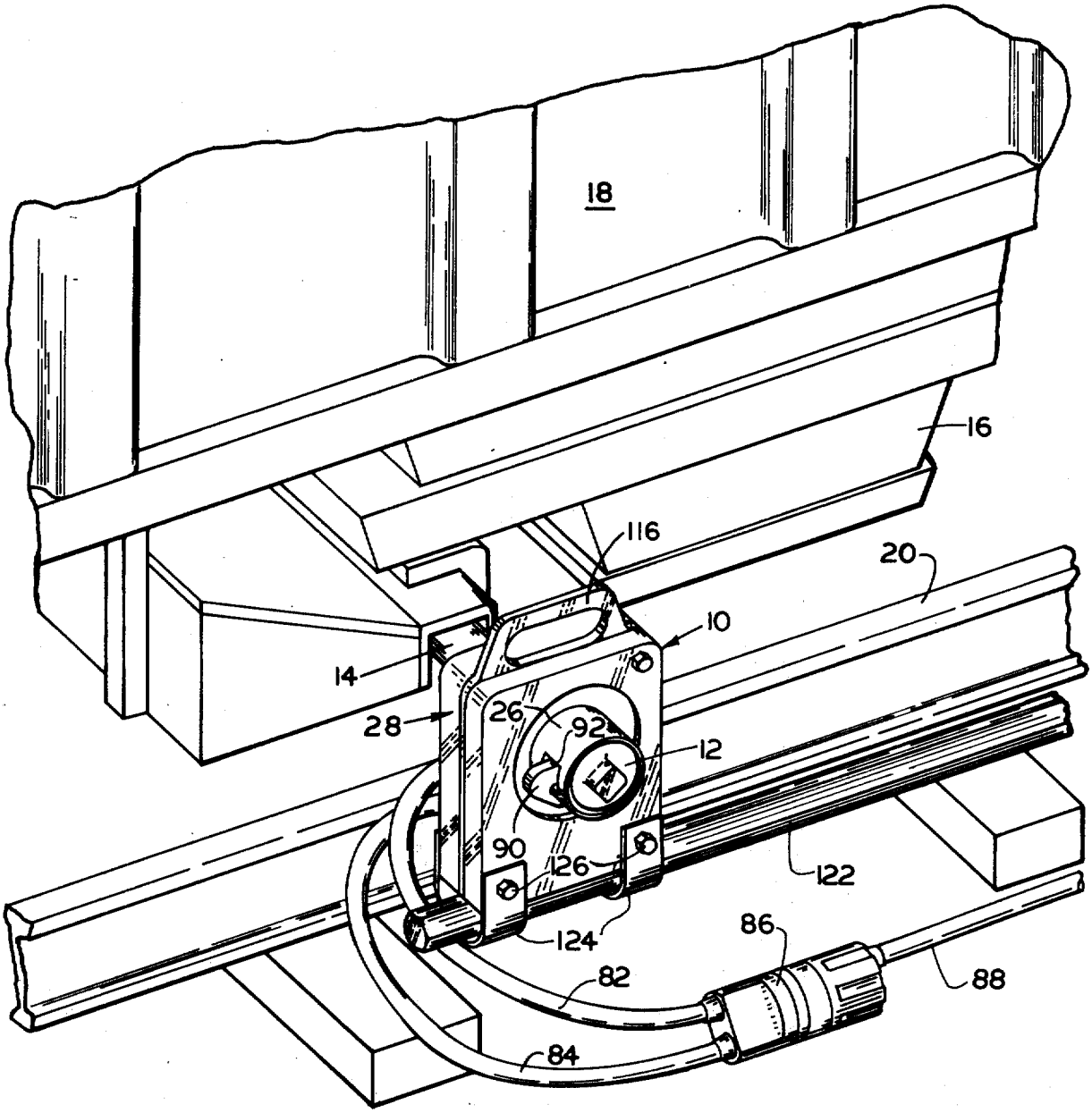
Figure 2:
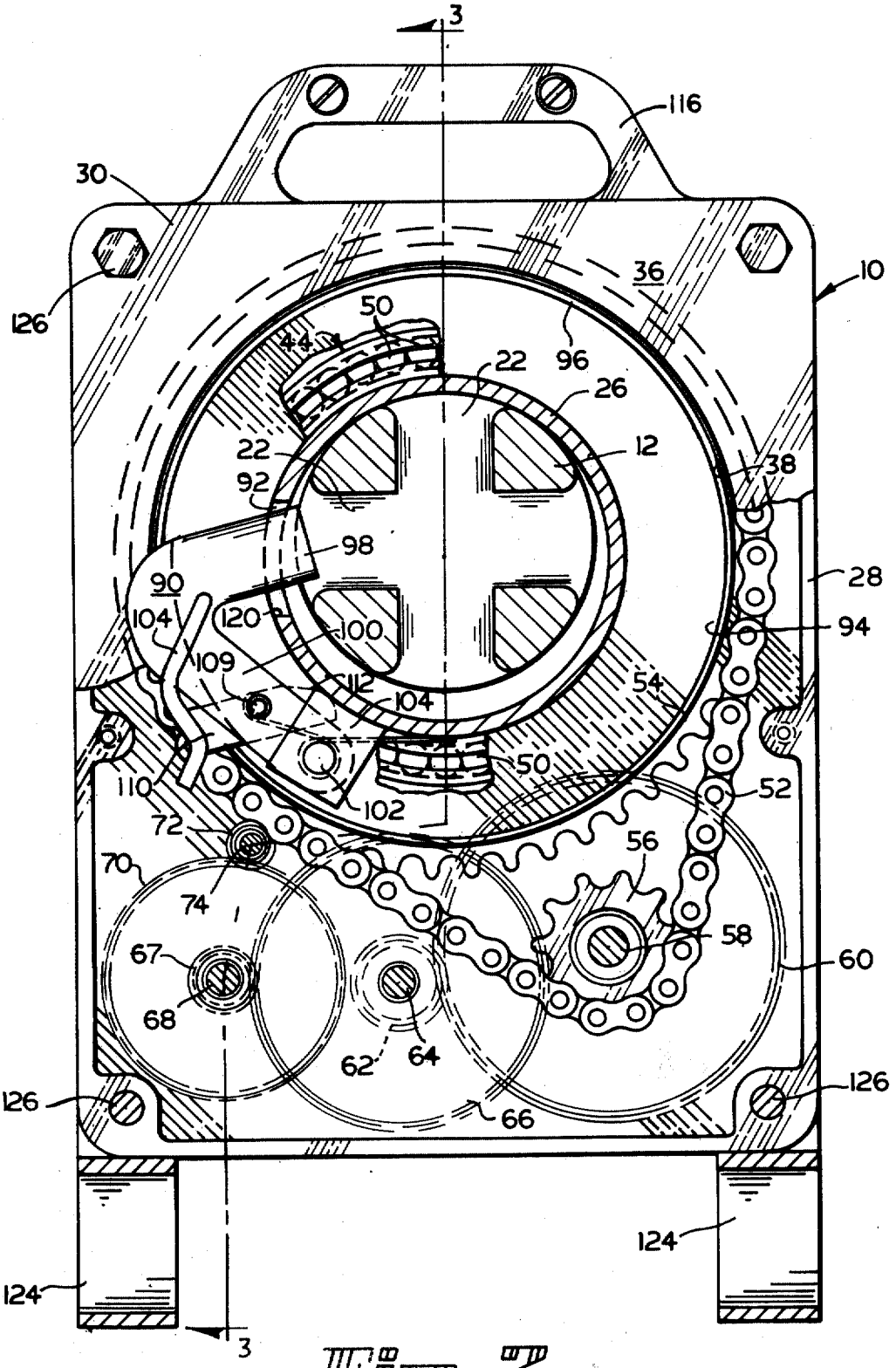
FIG. 2 is a front elevational view of the power wrench shown in FIG. 1, portions thereof being shown in section or broken away.

Since wrenches embodying the present invention are particularly applicable for opening hopper-car gates for railroad hopper cars, the wrench 10 is pictorially illustrated in FIG. 1 as mounted on the capstan 12 of a gate-operating shaft 14 for the sliding gate (not shown) at the bottom of the hopper 16 of a railroad car, only a portion 18 of which is shown. The operating shaft 14 on hopper cars is located at a level just above the rails 20 of the track with the capstan 12 extending no more than 6 or 8 inches outward of the adjacent rail, usually within the lateral extent of the adjacent side 18 of the car. The capstan 12 is provided with transverse holes 22 (FIG. 2) into which a crow-bar or pry-bar may be inserted in order to obtain leverage for rotating the operating shaft 14. Holes 22 in this instance are shown extending perpendicular to the axis about which shaft 14 is rotated, but on some cars the holes in the capstan slant outward of the side of the car as well as radially of the shaft, so that when the end of the pry-bar is inserted into the hole, the bar will extend outward of the side 18 of the car to any desired length.

However, even when an eight or ten foot bar is used, the gate on the car may be so solidly frozen closed that it is impossible for two, or even three, men working together to free it. In such situations it is common practice to strike the pry-bar with a sledge hammer in order to try to jolt the gate free. However, this practice is extremely dangerous because the hammer or other heavy object used can easily slip and seriously injure someone. Furthermore, such misuse of the equipment is the reason the tool surfaces on the capstan, especially the square-end portion and tool socket, become so badly damaged that they will not receive a tool, making it even more difficult to open the gate the next time.

Once the gate has been freed, it can usually be opened the rest of the way by a hand wrench. Prior power wrenches for opening hopper-car gates have encountered considerable difficulty in functioning properly, because the tool-connection is frequently so badly worn that a solid grip can not be made with it. Consequently, the power wrench simply slips uselessly without applying sufficient torque to turn the capstan, especially if the gate is frozen closed which, of course, if the time when such a wrench is needed most.

As mentioned hereinbefore, another disadvantage of prior power wrenches is that the power intended to be transmitted to the capstan is invariably initiated some distance axially outward of the point at which the tool is actually connected to the capstan. Such arrangements set up undesired force couples which rob the force-multiplying mechanism of its efficiency and create problems of holding the tool in line with the shaft to be rotated.

The wrench of the present invention, on the other hand, is designed to fit completely around the entire capstan 12, so that it can exert torque directly on the capstan with the power input disposed in the same plane with the point at which the wrench 10 is connected to the capstan. Thus, wrench 10 consists of a central hub 26, the inside diameter of which is greater than the outside diameter of the capstan 12, so that the wrench as a whole can be easily placed over the entire capstan, as illustrated in FIG. 1. Hub 26 is rotatably supported within a rugged metal housing 28 (FIGS. 2 and 3), consisting of two halves 30 and 32, which meet along a central gasketed parting line 34. The front wall 36 of the housing is provided with a large circular opening 38, through which one end of the hub 26 projects concentrically in spaced relationship therewith, while the rear wall 40 has a smaller opening 42, through which the opposite end of hub 26 fits in sealing engagement therewith.

Hub 26 is supported within a roller bearing 44, the outer race 46 of which is bolted to the rear wall 40 of the housing, while the inner race 48 is welded to the outer surface of hub 26. Rollers 50 completely fill the annular raceway formed between races 46 and 48. Hub 26 is driven by a roller chain 52, which travels over a large sprocket ring or bull-wheel 54 welded to hub 26 immediately in front of bearing 44. Chain 52, in turn, is driven by a small sprocket 56 (FIG. 2) journaled on a fixed shaft 58 with a large spur gear 60, to which it is integrally welded so that they rotate in unison. Gear 60 is the last in a series of speed-reduction gears which, together with the chain-drive for the bull-wheel 54, make up a force-multiplying drive system for hub 26.

Figure 3:
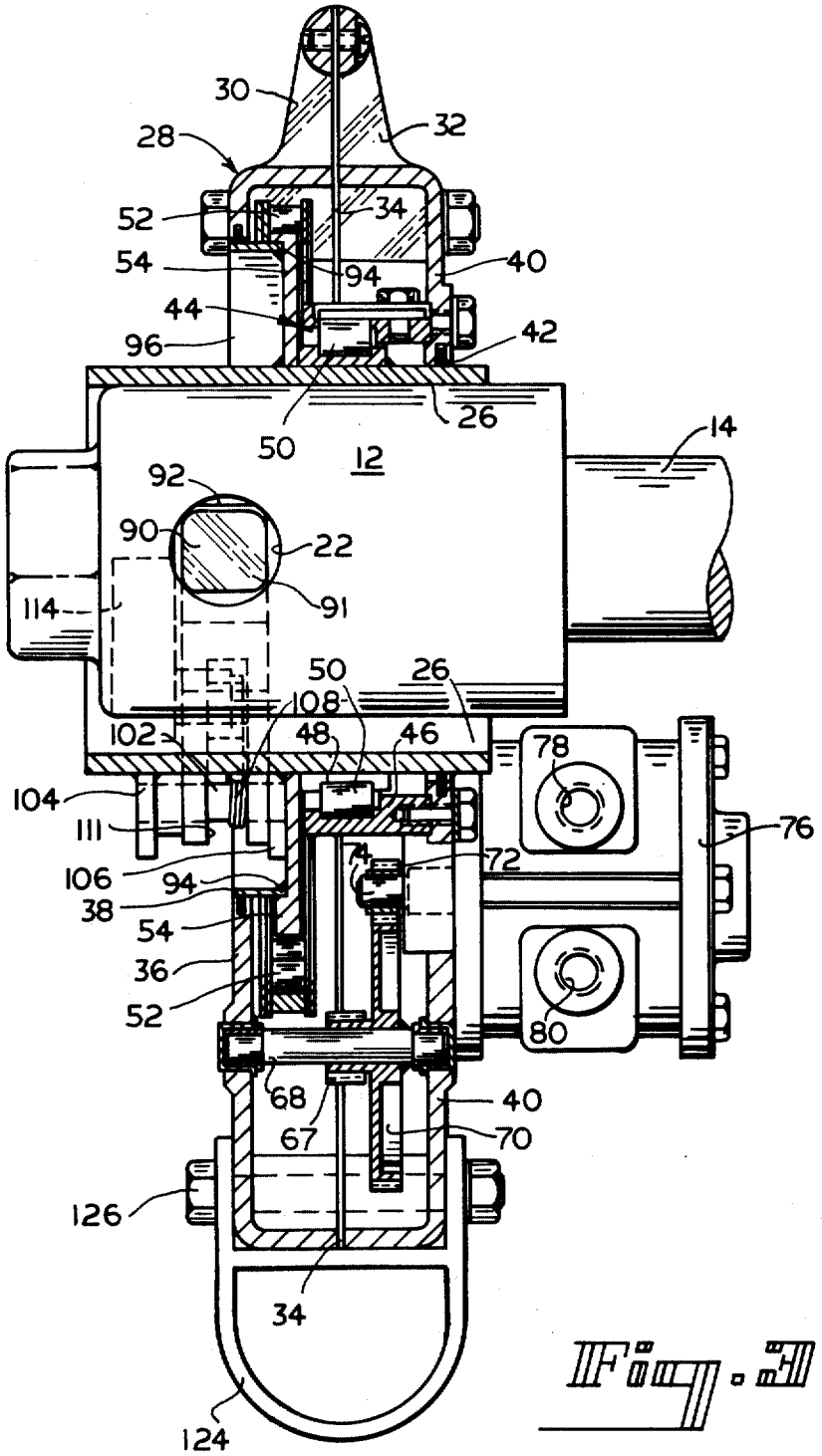
FIG. 3 is a sectional view thereof taken along the line 3—3 of FIG. 2.

In the gear train the spur gear 60 is driven by a small spur gear 62 rotatably mounted on a shaft 64 with a large spur gear 66, to which gear 62 is welded. Gear 66 meshes with a second small spur gear 67 that is fixed to, and rotates with, a gear shaft 68 on which is integrally mounted a third large spur gear 70. Gear 70 in turn is driven by a small spur gear 72 rigidly mounted on the drive shaft 74 of a motor 76 (FIG. 3) bolted to the rear wall 40 of housing 28. The motor drive shaft 74 and each of the gear shafts 58, 64 and 68 are disposed parallel to the axis of rotation of hub 26. As illustrated in FIG. 3, shaft 68 is rotatably supported at its ends in "Oilite" bearings provided in the front and rear walls 36 and 40 of the wrench housing 28. Gear shafts 58 and 64 are likewise mounted in the walls 36 and 40, but shaft 58 is provided with a sleeve bearing (not shown) on which sprocket 56 and gear 60 rotate in unison, while gears 62 and 66 are similarly journaled on shaft 64.

It will be noted that the forces exerted on the spur gear 70 by the drive gear 72 of the motor are directed in a drive-plane immediately adjacent, and parallel to, the drive-plane of gear 67 with gear 66, and that the drive-plane of gear 62 with gear 60 substantially coincides with that of the motor drive gear 74. Furthermore, the chain-drive 52–56 lies in a plane parallel to, and immediately adjacent, the drive-plane of gears 66 and 67, so that all the gears and sprockets in the drive system lie within a space of only a few inches between the front and rear walls of the housing. This drive arrangement is important in that all the forces are directed substantially in line with each other along the axes of rotation of the gear shafts and of the bull-wheel on hub 26.

In this instance, motor 76 is a reversible air motor having internally threaded openings 78 and 80, to which air hoses 82 and 84 (FIG. 1) are connected. Compressed air is furnished to one or the other of air hoses 82 and 84 from a hand-held control valve 86, to which air is supplied from a suitable source (not shown) by a supply line 88. When compressed air is directed to the motor 76 through hose 82, the wrench is driven in one direction while the hose 84 returns the exhaust air to control valve 86 where it is exhausted to the atmosphere. Control valve 86 may be actuated both to stop motor 76 and to reverse the flow of air through it, in order to reverse the direction of rotation of the wrench.

Mounted on the outer side of hub 26 is a releasable locking dog 90, one portion of which extends radially through a rectangular opening 92 in the hub for engagement within one of the holes 22 in capstan 12 on the operating shaft 14 for the hopper-car gate. Dog 90 should be located as close as possible to the sprocket 54 and yet be accessible to the operator, so that he can withdraw it from engagement with the capstan in order to remove the wrench from the car. To this end, sprocket 54 is undercut as shown in FIG. 3 as far as possible without unduly weakening it, in order to form a broad annular recess 94, within which locking dog 90 is received, so that it can be mounted closer to the drive-plane of the chain drive. In order to completely enclose the drive chain and gears, a metal ring or hoop 96 is welded to sprocket 54 within the perimeter of its annular recess 94, the ring 96 extending forward to, and sealing with, the circular opening 38 in the front wall 36.

Figure 4:
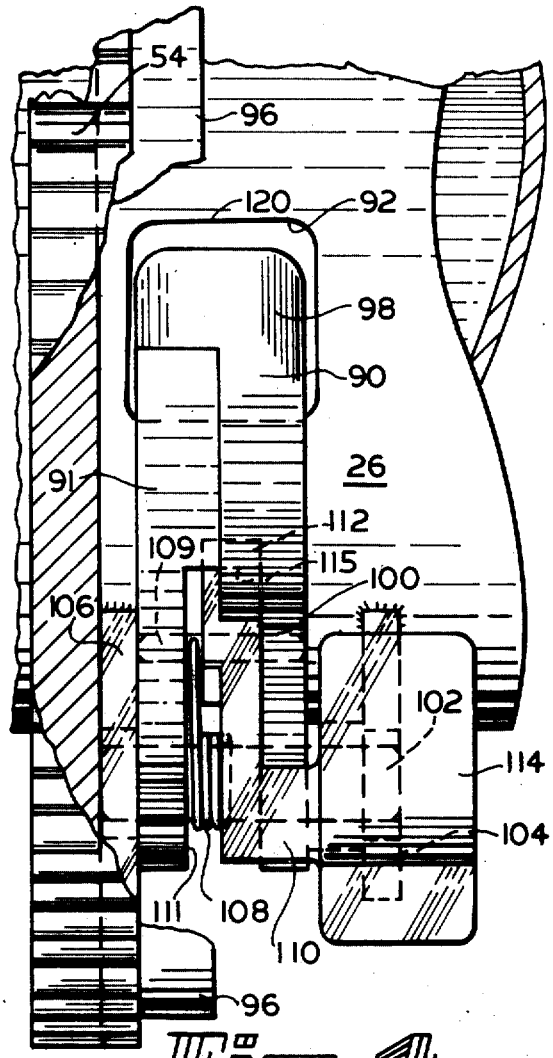
FIG. 4 is a detail view of the locking dog looking from left to right as shown in FIG. 2.
Figure 5:
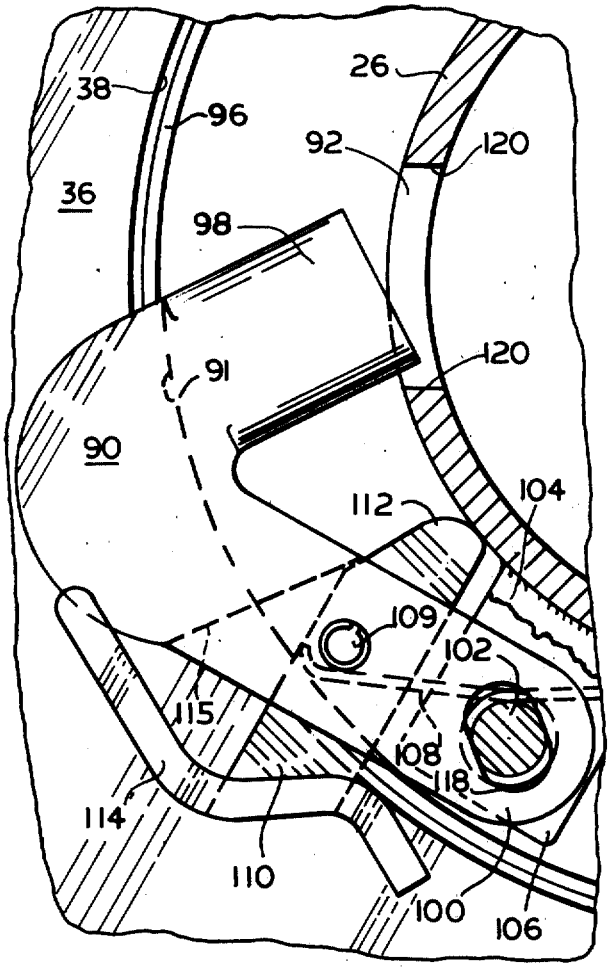
FIG. 5 is a detail view in front elevation of the locking dog shown in FIG. 2 but showing it latched in its retracted position.

Dog 90 is a heavy, hook-shaped casting having a rectangular locking portion 98 and a mounting portion 100 by which it is pivotally mounted on a pin 102 for movement of its locking portion 98 through the opening 92. Pin 102 is supported at its ends on a pair of lugs 104, 106 welded to the hub 26, one on each side of the mounting portion 100 of dog 90. Dog 90 is urged toward its locking position by a heavy torsion spring 108 having a coiled section encircling pin 102. One end of spring 108 presses against the periphery of hub 26, and the other extends in the opposite direction into engagement with a pin 109 on dog 90, urging the locking end inward through the opening 92. Since dog 90 lies partially within the sealing ring 96 on sprocket 54, as best seen in FIGS. 3 and 4, it is formed with an arcuate cut-away 91 on its inner side at the hump in the bend of the hook, so that it can be fully retracted, as shown in FIG. 5, before it engages ring 96.

In order to assist in withdrawing dog 90 from its locking position and to retain it in its retracted position, a release lever 110 is pivoted thereto on pin 109 within a longitudinal slot 111 in the mounting portion 100. A curved inner end 112 of lever 110 is disposed next to hub 26 for engagement therewith, and an S-shaped handle 114 is fixed to the outer end transversely thereof for pulling lever 110 counterclockwise about pin 109 in order to pry the dog outward. As will be noted in FIG. 5, when lever 110 is pivoted counterclockwise against the bottom 115 of slot 111 in dog 90, the end of locking portion 98 is fully retracted from the hole 22 in the capstan, so that the wrench can be removed. Likewise, when release lever 110 is in this position, its inner end is disposed slightly farther from the pivot pin 102 for dog 90 than the distance between its own pivot pin 109 and pin 102. Consequently, it will prop dog 90 in its retracted position against the pressure of torsion spring 108, permitting the operator to remove the wrench without having to hold the dog 90 retracted.

When the wrench is used, it is picked up by a convenient handle 116 formed integrally with the housing 28 and placed on the gate-operating capstan of a car. This is readily accomplished due to the fact that the hub is large enough to slip freely over the cylindrical capstan without having to match tool surfaces as in the case of conventional rectangular or hexagonal tool fittings. Furthermore, when the wrench is in place, its weight is completely carried by the capstan, making it unnecessary for the operator to hold it in place. The locking dog 90 is then released from its retracted position by pivoting lever 110 clockwise a short distance, so that the dog 90 can pivot into locking engagement with any one of the holes 22 in the capstan under the pressure of its actuating spring 108. Ordinarily it is desirable to place the wrench on the capstan so that the dog 90 is on the outside where it can be reached more easily. In some cases, however, the design of the car does not allow room for the motor 76 in back of the wrench. The wrench can then be placed on the capstan with the motor on the outside, in which case the dog release 110 can still be actuated on the far side of the wrench.

In order to prevent the wrench 10 from rotating about its hub 26 and the capstan 12 when it is operated, a heavy iron bar 122 (FIG. 1), such as the type used for manually opening the gate, is inserted through a pair of U-shaped steel straps or stirrups 124, 124 bolted to the bottom of the wrench housing 30 at its opposite sides thereof. Stirrups 124, 124 straddle the bottom edge of the wrench housing and are held by two of the through-bolts 126, by which the two half-sections of housing 28 are fastened together. Each bolt 126 extends through a hole in one leg of a stirrup 124, through the housing 28 and then through a hole in the other leg of the same stirrup on the opposite side of housing 28.

Depending on which direction the capstan 12 is to be rotated, the bar 122 will be extended mostly to one side or the other of the wrench, so that the long end will be driven against a fixed object, such as the ground or a railroad tie, for example, when the wrench is operated. In FIG. 1 the bar 122 is shown extending to the right of the wrench to prevent it from rotating clockwise when force is exerted on the capstan to rotate it counterclockwise. If desired stirrups 124, 124 can be mounted on the long edge of the wrench housing, instead of at the bottom, so that the wrench can be disposed sideways in case the capstan is too close to the ground for the wrench to fit when it is upright.

Stirrups 124, 124, as well as bar 122, all lie within the same drive-plane as the gear-train, chain-drive and locking dog of the wrench, thereby maintaining alignment of all forces from those exerted by the motor on the force-multiplying system to the capstan, as well as to the counter-balancing reaction force exerted by the bar 122 against the ground.

It will be noted from FIG. 5 that the holes 118, 118 in the mounting portion 100 of dog 90, through which the pivot pin 102 extends, are elongated in order to let the dog 90 move lengthwise a short distance. Limited movement of the dog in this direction relative to pin 102 is necessary so that its locking portion 98 can be driven into full engagement with one of the end surfaces 120, 120 of the opening 92 in hub 26 when pressure is applied to the capstan after the dog is engaged therewith. All the force exerted by the hub 26 for rotating the capstan is thus transmitted to the dog 90 by the hub itself at the ends of the opening 92 rather than through the pivot pin 102.

I claim:

1. A portable high-torque wrench for rotating a cylindrical capstan having a transverse hole in the periphery thereof by which to rotate it, said wrench comprising in combination a frame having a central opening therein, a cylindrically hollow hub rotatably supported within the central opening of said frame and open at least at one end to receive and completely surround said capstan substantially within a plane of rotation disposed perpendicular to said capstan, means for rotating said hub and a locking dog mounted on said hub substantially in said plane of rotation and having a portion slidably movable radially into and out of said hole in said capstan for driving engagement therewith.

2. A wrench as defined in claim 1, wherein said frame comprises front and rear walls spaced parallel to each other for supporting said hub with its axis of rotation disposed perpendicular to said walls, said means for rotating said hub comprising a reduction-gear train having gears mounted between and supported by said front and rear walls with their axes of rotation disposed parallel to said hub axis, said wrench being also provided with anti-rotation means mounted on said frame substantially within said plane of rotation for preventing rotation of said frame, such that said hub, gear-train, anti-rotation means and locking dog are aligned substantially within said plane of rotation whereby the forces exerted by and between them are in virtual alignment.

3. A wrench as defined in claim 2, wherein said hub is provided with a lateral opening through which said slidable portion of said locking dog extends for engagement with said capstan, said locking dog being mounted such that it can move circumferentially of said hub into engagement with the edge of said opening so that it is supported thereby when torque is exerted on said capstan by said hub.

4. A wrench as defined in claim 3, wherein said locking dog is pivoted on said hub and is a hook-shaped member with a locking end-portion comprising said slidable portion on one side of the bend in the hook and a mounting portion on the other by which said locking dog is pivoted for movement of said locking end-portion into engagement with said capstan, said wrench further including means for mounting said locking dog for movement of said locking portion circumferentially of said hub into engagement with an edge of said opening in said hub so that it is supported thereby when torque is exerted on said capstan by said hub.

5. A wrench as defined in claim 4, wherein said means for mounting said locking portion comprises a pivot pin fixed to said hub adjacent said opening and extending through an enlarged hole in said mounting portion of said locking dog.

6. A wrench as defined in claim 4, which further includes a spring for urging said locking dog into locking engagement with said capstan, and a release lever having a free end for engagement with said hub, said release lever being pivotally mounted on said locking dog at a fixed distance from said pivot pin for pivotal movement in one direction into a propping position in which said dog is held retracted from engagement with said capstan by said release lever in said one direction beyond its propping position.

7. A wrench as defined in claim 6, wherein said release lever is pivoted to said dog intermediate said pivot pin and said locking end-portion of said dog and said release lever has a handle disposed on the opposite side of its pivot connection with said dog from its said free end, such that movement of said handle for pivoting said release lever toward its propping position is in the direction for retracting said dog, said free end of said release lever being disposed for engagement with said hub when said lever is being pivoted in said direction, such that said release lever provides a mechanical advantage for retracting said dog, the distance from said pivot point for said dog to the point of engagement between said release lever and hub being less than said fixed distance from said pivot pin to said pivot connection for said release lever until said dog is fully retracted from engagement with said capstan, while the distance from said pivot pin is greater than said fixed distance when said release lever is in its propping position.

8. A wrench as defined in claim 2, wherein said reduction gear train is connected to said hub by a roller chain trained over a small sprocket driven by the last gear in said gear train and then over a large sprocket rigidly mounted on said hub.

9. A power wrench for operating the gate-mechanism on a railroad hopper-car having a capstan with a hole in the periphery extending radially thereof, said wrench comprising in combination a frame, a hollow hub rotatably mounted on said frame about a fixed axis and opening in at least one direction axially thereof so that it can be disposed around said capstan, force-multiplying means drivingly connected to said hub for rotating the same, means for driving said force-multiplying means, anti-rotation means for preventing rotation of said frame on operation of said drive means, a hook-shaped locking dog having a locking portion on one side of its bend and a mounting portion on the other by which said locking dog is pivoted to said hub for radial movement of said locking portion into engagement with said capstan within said hole, said hub having a lateral opening through which said locking portion of said dog extends, and means for mounting said locking dog for movement circumferentially of said hub into engagement with an edge of said opening so that it is supported thereby when torque is exerted on said capstan by said hub.

10. A power wrench as defined in claim 9, wherein said means for mounting said locking portion comprises a pivot pin fixed to said hub adjacent said opening and extending through an enlarged hole in said mounting portion of said locking dog.

11. A power wrench as defined in claim 9, which further includes a spring for urging said locking dog into locking engagement with said capstan and a release lever having a free end for engagement with said hub, said release lever being pivotally mounted on said locking dog at a fixed distance from said pivot pin for pivotal movement in one direction into a propping position in which said dog is held retracted from engagement with said capstan by said release lever, and means for preventing the movement of said release lever in said one direction beyond its propping position.

12. A power wrench as defined in claim 11, wherein said release lever is pivoted to said dog intermediate said pivot pin and said locking-end portion of said dog and said release lever has a handle disposed on the opposite side of its pivot connection with said dog from its said free end, such that movement of said handle for pivoting said release lever toward its propping position is in the direction for retracting said dog, said free end of said release lever being disposed for engagement with said hub when said release lever is being pivoted in said direction, such that said release lever provides a mechanical advantage for retracting said dog, the distance from said pivot point for said dog to the point of engagement between said release lever and hub being less than said fixed distance from said pivot pin to said pivot connection for said release lever until said dog is fully retracted from engagement with said capstan, while the distance from said point of engagement to said pivot pin is greater than said fixed distance when said release lever is in its propping position.

* * * * *